US012152826B2

(12) United States Patent
Rajan et al.

(10) Patent No.: US 12,152,826 B2
(45) Date of Patent: Nov. 26, 2024

(54) LID ASSEMBLY FOR CONTROLLING HUMIDITY IN A REFRIGERATOR

(71) Applicants: BSH Home Appliances Corporation, Irvine, CA (US); BSH Hausgeräte GmbH, Munich (DE)

(72) Inventors: Elena Rajan, Maryville, TN (US); Cetin Abdullah Celik, Knoxville, TN (US); Cemalettin Hasturk, Knoxville, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 185 days.

(21) Appl. No.: 17/986,935

(22) Filed: Nov. 15, 2022

(65) Prior Publication Data

US 2024/0159451 A1 May 16, 2024

(51) Int. Cl.
*F25D 23/02* (2006.01)
*F25D 29/00* (2006.01)

(52) U.S. Cl.
CPC ..... *F25D 23/028* (2013.01); *F25D 29/00* (2013.01)

(58) Field of Classification Search
CPC ..... F25D 23/028; F25D 23/069; F25D 29/00; F25D 25/025; F25D 2317/04131; F25D 17/042; F25D 2700/04
See application file for complete search history.

(56) References Cited

U.S. PATENT DOCUMENTS

| | | | | |
|---|---|---|---|---|
| 5,044,704 | A | 9/1991 | Bussan et al. | |
| 9,759,479 | B2 | 9/2017 | Ramm et al. | |
| 10,006,693 | B2 | 6/2018 | Ramm et al. | |
| 10,203,151 | B2 | 2/2019 | Cizik et al. | |
| 10,415,875 | B2 | 9/2019 | Biotti et al. | |
| 2022/0316793 | A1* | 10/2022 | Hanson | B01D 53/0415 |
| 2022/0349648 | A1* | 11/2022 | Li | F25D 25/025 |

FOREIGN PATENT DOCUMENTS

| | | | | |
|---|---|---|---|---|
| CA | 2453683 | A1 | 6/2005 | |
| CN | 103277964 | B | 5/2015 | |
| CN | 103591758 | B | 4/2017 | |
| CN | 111692823 | A | 9/2020 | |
| CN | 212320179 | U | 1/2021 | |
| CN | 111189289 | B * | 10/2021 | F25D 25/025 |
| EP | 3077746 | B1 * | 3/2021 | F25D 25/025 |
| GB | 2414064 | B | 8/2007 | |
| WO | WO-2020104171 | A1 * | 5/2020 | F25D 17/042 |
| WO | 2021190006 | A1 | 9/2021 | |

* cited by examiner

*Primary Examiner* — Emmanuel E Duke
(74) *Attorney, Agent, or Firm* — Michael E. Tschupp; Andre Pallapies; Brandon G. Braun

(57) ABSTRACT

A lid assembly for controlling humidity in a refrigeration appliance can be provided that can include a division plate positioned between a first compartment of the refrigeration appliance and a second compartment of the refrigeration appliance for insulating the first compartment. The division plate can include a first component that defining an inlet in the division plate and a second component protruding from the division plate. Additionally, the lid assembly can include a lid that can have a third component and a fourth component. The third component can be coupled to the first compartment such that third component is at least partially inside the inlet defined by the first component and the fourth component can be coupled to the second component.

20 Claims, 7 Drawing Sheets

LID ASSEMBLY FOR CONTROLLING HUMIDITY IN A REFRIGERATOR

TECHNICAL FIELD

The present disclosure relates generally to refrigeration systems and, more particularly (although not necessarily exclusively), to a lid assembly for controlling humidity in a refrigeration appliance.

BACKGROUND

A refrigeration system can include at least one storage compartment, such as a crisper drawer, to preserve perishables. The crisper drawer can have a different level of humidity than a body of the refrigeration system and other storage compartments within the refrigeration system to optimize freshness of fruits, vegetables, or other suitable perishables stored in the crisper drawer. A user can set a humidity level of the crisper drawer and the refrigeration system can include vents or other suitable components to generate the humidity level.

DETAILED DESCRIPTION

Figure 1:
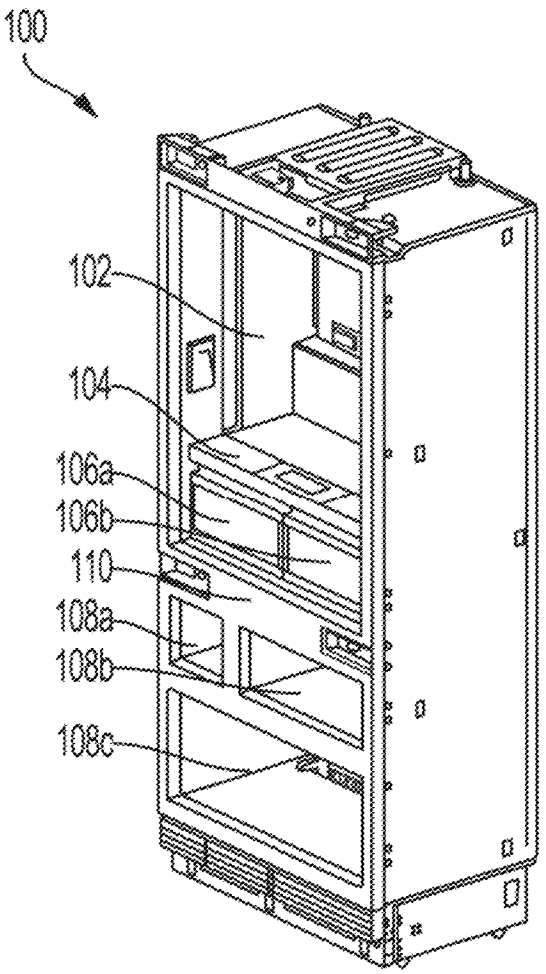
FIG. 1 is a schematic of a refrigerator that can include a lid assembly according to one example of the present disclosure.

Certain aspects and examples of the present disclosure relate to a lid assembly for controlling humidity in a refrigeration appliance. The refrigeration appliance can be a refrigerator, a freezer, or another suitable refrigeration appliance. The refrigeration appliance can include compartments in a body of the refrigeration appliance for storing food or other perishables. The compartments can be refrigeration compartments, freezer compartments, crisper drawers, or other suitable compartments. In an example, the lid assembly can be integrated with a crisper drawer to maintain and control a humidity level of the crisper drawer. Additionally, the lid assembly may be integrated with the freezer compartments, the refrigeration compartments, or other suitable compartments, or a combination thereof for regulating temperature, humidity, or other environmental characteristics of the compartments. The lid assembly can include a lid and a division plate. The division plate can be a device for separating compartments in a refrigeration appliance and for insulating the compartments in the refrigeration appliance. The division plate can be inserted into a compartment to create two compartments, or the division plate may be positioned proximate to a compartment. For example, the division plate can be positioned on a top portion of a drawer to separate the drawer from the body of the refrigeration appliance. The lid can further insulate the compartments and the lid can enable a user to access to the compartments.

The lid assembly can include the lid at least partially placed inside the division plate to increase a usable volume in a compartment, such as a drawer, of the refrigeration appliance. The lid assembly can control the humidity or temperature of the compartment by insulating the compartment. By controlling the humidity or temperature of the compartment the lid assembly can improve preservation of perishables in the refrigeration appliance. For example, a particular type of fruit or vegetable can remain fresh for a longer period of time in a humid environment. The lid assembly can further include electronics for enabling the lid to open or close automatically to provide the user access to the compartment.

In a particular example, the refrigeration appliance can include a body of the refrigeration appliance and a drawer. The lid assembly can include the division plate, which can be positioned between the body of the refrigeration appliance and the drawer. The division plate can insulate the drawer. The division plate can include a first component defining an inlet in the division plate and a second component protruding from the division plate. The lid assembly can further include the lid, which can be positioned below the division plate. The lid can include a third component coupled to the first component of the division plate such that the third component can be at least partially inside the inlet. The third component can be a curved member that can hook on the first component. The lid can further include a fourth component coupled to the second component of the division plate. The second component may be rotated by a motor to cause, via the connection with the fourth component, an adjustment to a position of the lid.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic of a refrigeration appliance 100 that can include a lid assembly 104 according to one example of the present disclosure. Examples of the refrigeration appliance 100 can include a refrigerator, a freezer, or other suitable household appliance with cold storage.

The refrigeration appliance 100 can have a top portion including a body section 102, a first drawer 106*a*, and a second drawer 106*b*. The body section 102 can be a refrigeration section. For example, the body section 102 can have a temperature between thirty-two and forty degrees Celsius and can have a relative humidity of sixty-five percent. Relative humidity can be a measure of an amount of water vapor in an air-water mixture. In some examples, the temperature and relative humidity provided in the first drawer 106*a* and the second drawer 106*b* can be different than the body section 102. For example, the first drawer 106*a* can have a temperature between ten and sixteen degrees Celsius and a relative humidity of sixty percent. The second drawer

106*b* can have a temperature between zero and four degrees Celsius and a relative humidity of ninety-five percent. The temperature, relative humidity, or other suitable characteristics of the body section 102, the first drawer 106*a*, or the second drawer 106*b* can be adjustable.

Additionally, a lid assembly 104 can be included in the refrigeration appliance 100 for maintaining the temperature, the relative humidity, other environmental characteristics, or a combination thereof of the first drawer 106*a* and the second drawer 106*b*. The lid assembly 104 can include a division plate and a lid. The division plate can be a top portion of the lid assembly 104 to separate the body section 102 from the drawers 106*a-b*. The division plate can further insulate the drawers 106*a-b* to maintain temperature, relative humidity, or the like of the first drawer 106*a* and the second drawer 106*b*. The division plate can insulate the drawers 106*a-b* by preventing airflow between the body section 102 and the first drawer 106*a* and the second drawer 106*b*. The division plate can also include insulating properties. For example, the division plate can include an insulating material such as a polyurethane. Additionally, the lid can be a bottom portion of the lid assembly. The lid can be detachably coupled with the first drawer 106*a* and the second drawer 106*b*. The lid can enable a user to access the first drawer 106*a* or the second drawer 106*b* in an open position. Additionally, the lid can be in a closed position to maintain the temperature, relative humidity, or the like of the first drawer 106*a* and the second drawer 106*b*.

The refrigeration appliance can further include a bottom section that can be separated from the top section by a divider 110. The bottom section can include compartments 108*a-c*. In some examples, the compartments 108*a-c* can be freezer compartments, icemaker compartments, refrigeration compartments, or other suitable compartments. In some examples, additional lid assemblies can be included in the refrigeration appliance for one or more of compartments 108*a-c*.

Figure 2:
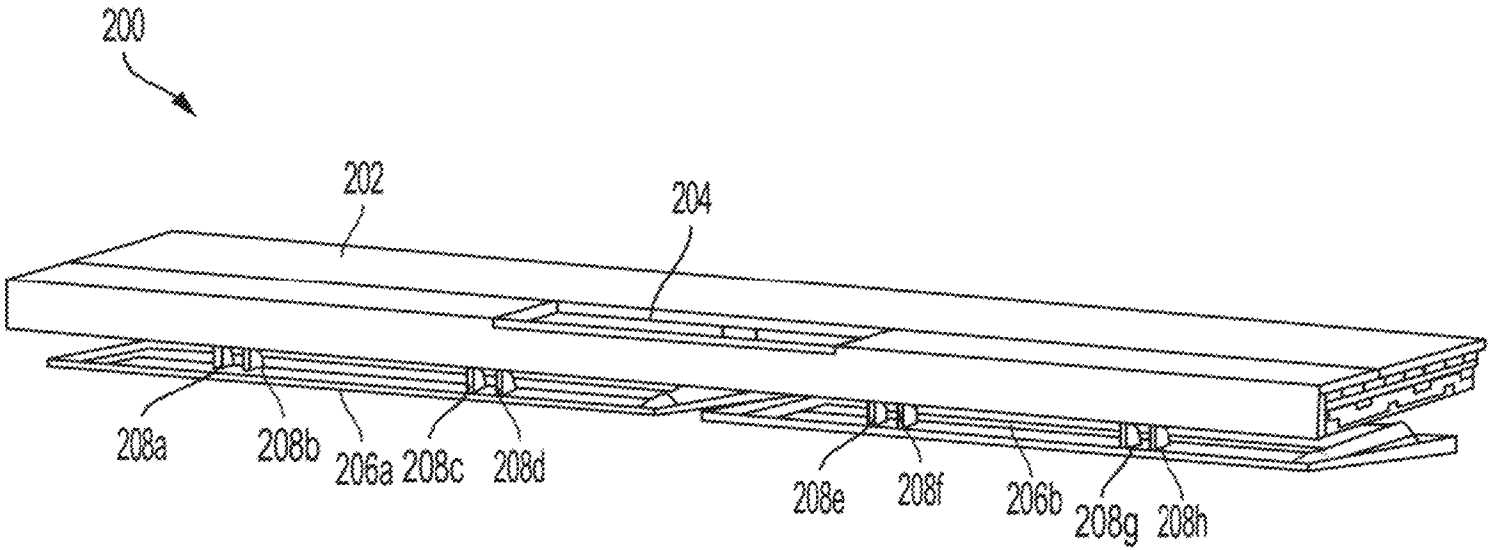
FIG. 2 is a schematic of an example of a lid assembly for controlling humidity in a refrigeration appliance according to one example of the present disclosure.

FIG. 2 is a schematic of an example of a lid assembly 200 for controlling humidity in a refrigeration appliance according to one example of the present disclosure. The lid assembly 200 can correspond to the lid assembly 104 of FIG. 1. The lid assembly can include a division plate 202, which can be a device for separating compartments in a refrigeration appliance and insulating the compartments in a refrigeration appliance. The division plate 202 may include an opening 204 in which electronics can be stored. The lid assembly 200 can open automatically to provide access to a drawer, compartment, or the like associated with the lid assembly 200 for a user.

The lid assembly 200 can further include lids 206*a-b*. The lids 206*a-b* can be positioned proximate to a bottom side of the division plate 202. In an example, a first lid 206*a* can be positioned on a first drawer 106*a* and a second lid 206*b* can be positioned on a second drawer 106*b*. The first lid 206*a* can include components 208*a-d* for coupling the first lid 206*a* and the division plate 202. The components 208*a-d* can be at least partially inserted into the division plate 202 to decrease space between the first lid 206*a* and the division plate 202. The second lid 206*b* can also include components 208*e-h* that can be at least partially inserted into to the division plate 202 to couple the division plate 202 and the second lid 206*b*.

Figure 3:
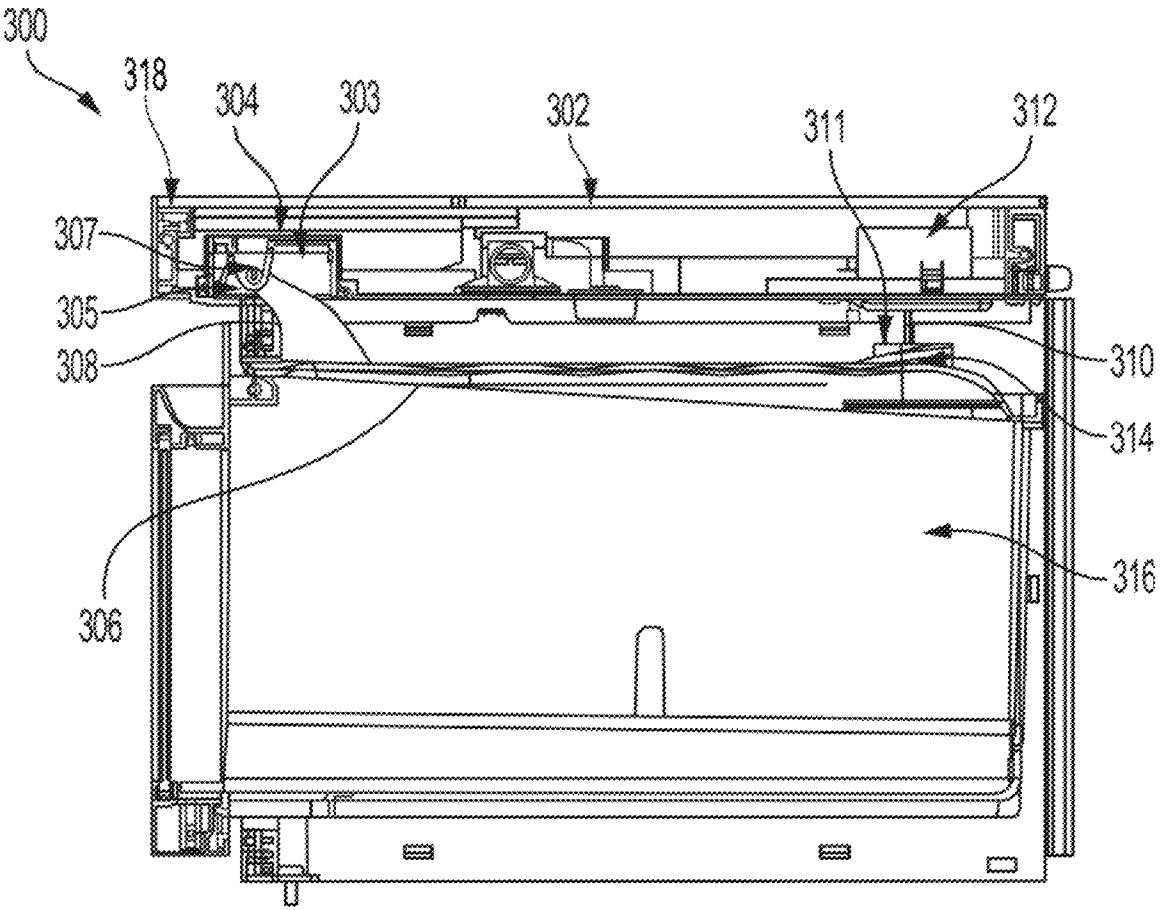
FIG. 3 is a schematic of an example of a lid assembly coupled with a compartment for controlling humidity in the compartment according to one example of the present disclosure.

FIG. 3 is a schematic of an example of a lid assembly 300 for controlling humidity in a refrigeration appliance according to one example of the present disclosure. The lid assembly 300 can include a division plate 302 positioned proximate to a compartment 316 of the refrigeration appliance. As illustrated, the division plate 302 can be positioned on top of the compartment 316. The lid assembly 300 can further include a lid 306 positioned between the division plate 302 and the compartment 316. In the refrigeration appliance, the division plate 302 can separate the compartment 316 from one or more additional compartments of the refrigeration appliance. The division plate 302 can control humidity, temperature, and the like of the compartment 316 by obstructing airflow from the additional compartments to the compartment 316. The division plate 302 or the lid 306 may also have insulating properties, such as being made of an insulating material (e.g., polyurethane, expanded polystyrene, cellular glass, etc.).

Additionally, the division plate 302 can include a first component 304 that can define an inlet 303 in the division plate 302 and second component 310 that can protrude from the division plate 302. The first component 304 can further include or define a coupling mechanism. As depicted, the coupling mechanism can be a hook mechanism 305. The lid 306 can have a third component 308 with a protruding portion 307. In some examples, the third component 308 can be a curved member. The hook mechanism 305 can be fastened around the protruding portion 307 to couple the first component 304 and the third component 308. The coupling of the first component 304 and the third component 308 can position the third component 308 in the inlet 303. In some examples, an upper half of the third component 308 can be in the inlet 303. In additional examples, any portion of the third component can be in the inlet 303. The coupling of the first component 304 and the third component 308 can increase a usable volume of the compartment 316 by increasing a height of the position of the lid 306 with respect to the compartment 316.

The second component 310 can be attached to a fourth component 314 of the lid 306. In some examples the second component 310 can be cylindrical and can have a portion 311 larger in diameter on a bottom of the second component for coupling with the fourth component 314. A motor 312 can cause the second component 310 to rotate. The fourth component 314 can have a beveled and rounded edge. Rotation of the second component 310 by the motor 312 can adjust the position of the lid 306. For example, rotation of the second component 310 can lift or lower the lid by changing a position of the second component 310 with respect to the fourth component 314. The motor 312 can be in an opening for electronics that can be embedded in the division plate 302. The motor 312 or other suitable electronics can facilitate automatic opening or closing of the lid 306. In an example, a sensor 318, such as a motion sensor, can detect a user intent to open the lid 306 and, in response, the motor 312 can rotate to cause the lid 306 to open. The first component 304 of the division plate 302 and the third component 308 of the lid 306 can be attached during movement of the lid 306. The hook mechanism 305 and the protruding portion 307 can rotate with respect to one another to remain connected during the movement of the lid 306.

Figure 4:
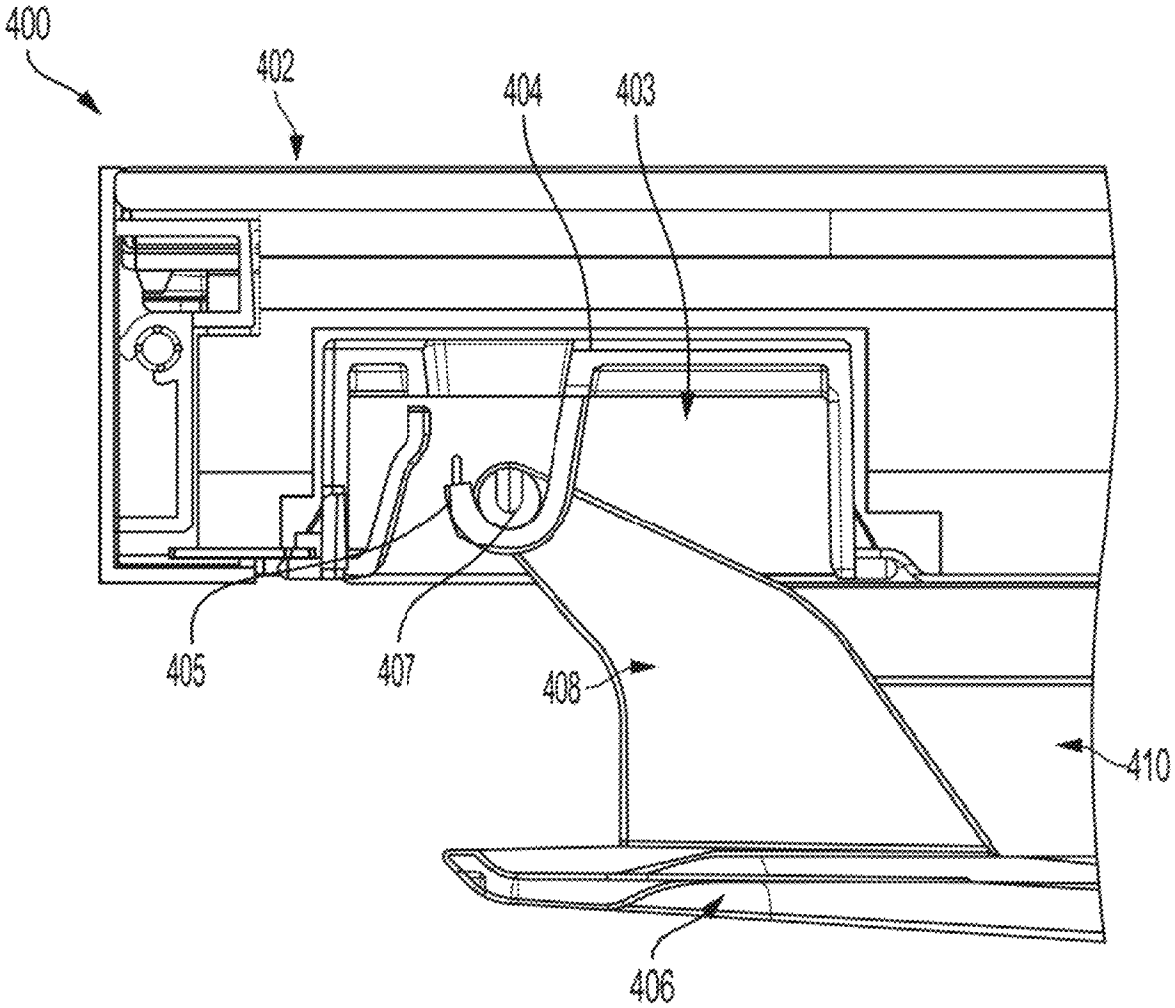
FIG. 4 is a schematic of an example of a couple mechanism that can be included in a lid assembly according to one example of the present disclosure.

FIG. 4 is a schematic of an example of a coupling mechanism that can be included in a lid assembly 400 according to one example of the present disclosure. The coupling mechanism can consist of a first component 404 of a division plate 402. The first component 404 can define an inlet 403 in the division plate 402. The inlet 403 can be on a bottom portion of the division plate 402 and can be any suitable shape or size. Additionally, the first component 404 can have a hook mechanism 405 for attaching to a second component 408 of a lid 406. In some examples, the hook mechanism 405 can be formed from the first component 404 or the hook mechanism 405 can be attached to the first component 404. For example, the hook mechanism 405 can fit into a hole defined at an end of the first component 404. The second component 408 can include a protruding portion 407 to which the hook mechanism 405 can be fastened. Due to the coupling of the protruding portion 407 and the hook mechanism 405, the second component 408 can be positioned inside the inlet 403. This can decrease a size of a space 410 between the division plate 402 and the lid 406, thereby increasing a usable volume of a compartment associated with the lid assembly 400.

Figure 5:
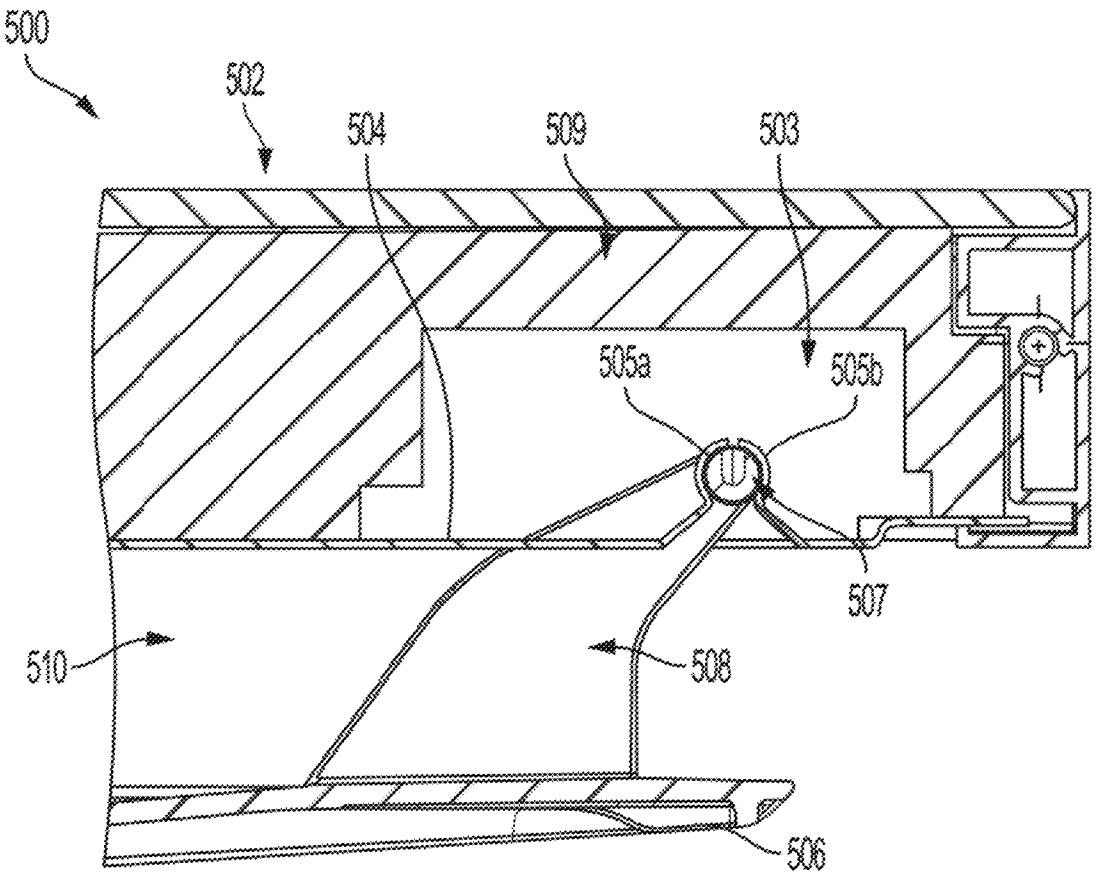
FIG. 5 is a schematic of another example of a coupling mechanism that can be included in a lid assembly according to one example of the present disclosure.

FIG. 5 is a schematic of another example of a coupling mechanism that can be included in a lid assembly 500 according to one example of the present disclosure. The coupling mechanism can consist of a first component 504 of a division plate 502. The first component 504 can be molded from sheet metal on a bottom side of the division plate 502. The division plate 502 can include an inlet 503 formed in an insulation portion 509 of the division plate 502. The insulation portion 509 of the division plate 502 can be made of expanded polystyrene (EPS) or another suitable material. Additionally, the first component 504 can define hook mechanisms 505*a-b* for attaching to a second component 508 of a lid 506. The second component 508 can include a protruding portion 507 to which the hook mechanisms 505*a-b* can be fastened. A first hook mechanism 505*a* can encompass a first portion of the protruding portion and a second hook mechanism 505*b* can encompass a second portion of the protruding portion 507. The first portion and the second portion can be less than a circumference of the protruding portion 507. The hook mechanisms 505*a-b* can be of sufficient mechanical strength and size to secure the second component 508 in the inlet 503. The positioning of the second component 508 in the inlet 503 can decrease a size of a space 510 between the division plate 502 and the lid 506. This can further increase a usable volume of a compartment associated with the lid assembly 500.

Figure 6:
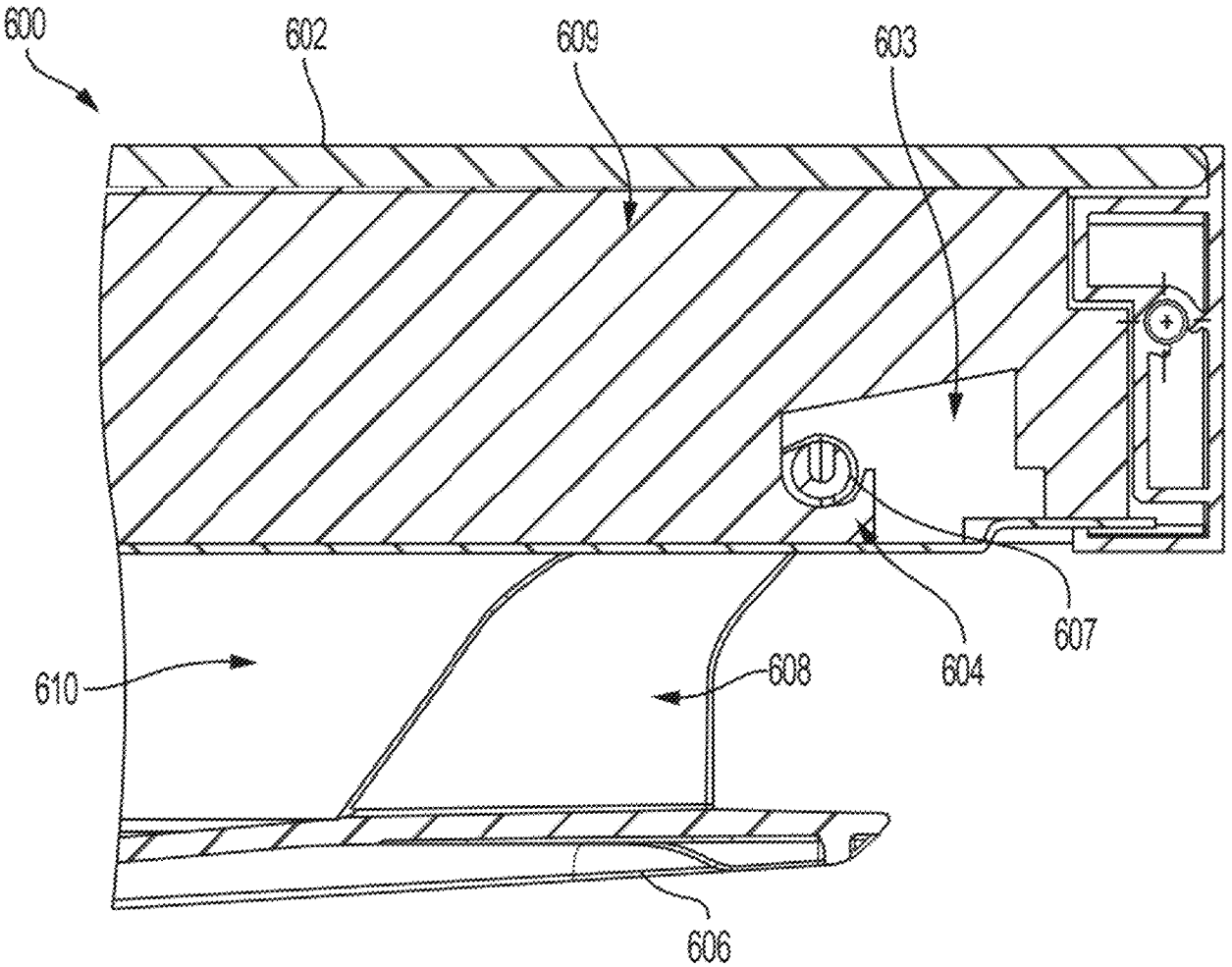
FIG. 6 is a schematic of another example of a coupling mechanism that can be included in a lid assembly according to one example of the present disclosure.

FIG. 6 is a schematic of another example of a coupling mechanism that can be included in a lid assembly 600 according to one example of the present disclosure. The coupling mechanism can consist of a first component 604 of a division plate 602, which can be formed or molded from an insulation portion 609 of the division plate 602. The insulation portion 609 can be made of EPS or another suitable material. The first component 604 can further define an inlet 603 in the division plate 602. Additionally, the first component 604 can define a hook mechanism 605 for attaching to a second component 608 of a lid 606. The second component 608 can include a protruding portion 607 to which the hook mechanism 605 of the first component 604 can be fastened. The coupling of the protruding portion 607 and the hook mechanism 605 can position the second component 608 in the inlet 603, which can decrease a size of a space 610 between the division plate 602 and the lid 606. This can further increase a usable volume of a compartment associated with the lid assembly 600.

Figure 7:
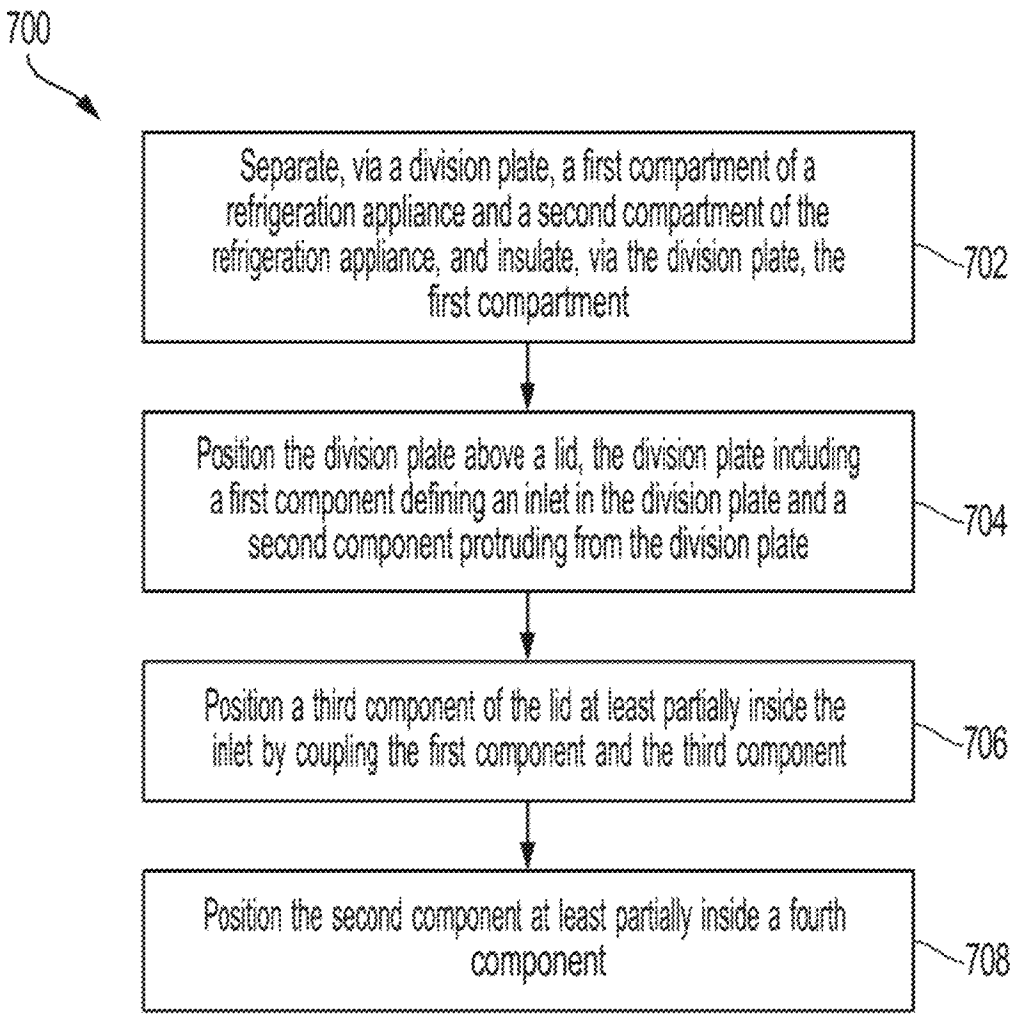
FIG. 7 is a flowchart of a processing for controlling humidity in a refrigeration appliance using a lid assembly according to one example of the present disclosure.

FIG. 7 is a flowchart of a process 700 for controlling humidity in a refrigeration appliance using a lid assembly 300 according to one example of the present disclosure. The lid assembly 300 can control the humidity by separating a compartment 316, such as a crisper drawer, from additional compartments of the refrigeration appliance. Additionally, the lid assembly 300 may automatically open or close a lid 306 in response to user interaction to facilitate efficient access to the compartment 316. Automatic closing of the lid 306 can further limit unnecessary exposure to an outside environment to limit an effect of the outside environment on the humidity, temperature, etc. of the compartment 316. Aspects of FIG. 7 are discussed with respect to the components of FIG. 3.

At block 702, the lid assembly 300 can control humidity by separating, via a division plate 302, a first compartment of a refrigeration appliance and a second compartment of the refrigeration appliance, and insulate, via the division plate 302, the first compartment. The division plate 302 can be positioned above the first compartment and below the second compartment. The division plate 302 can insulate the first compartment by preventing airflow between the first compartment and the second compartment. The division plate 302 can further exhibit insulating properties such as high resistance to water absorption, high mechanical strength, low density, etc. The division plate 302 can be made of an insulating material, such as EPS, which can have the above-mentioned properties.

At block 704, the lid assembly 300 can control humidity by positioning the division plate 302 above a lid 306, the division plate 302 including a first component 304 defining an inlet 303 in the division plate 302 and a second component 310 protruding from the division plate 302. The division plate 302 can separate the first compartment from the second compartment while the lid 306 can provide access to the first compartment for a user. The first component 304 can be molded or formed from sheet metal, EPS, or another suitable material or component of the division plate 302. The inlet 303 can provide an area in which the lid 306 can be at least partially disposed to position the lid 306 at a higher height relative to the first compartment. The second component 310 can be associated with a motor 312 and can be coupled with a fourth component 314 of the lid 306.

At block 706, the lid assembly 300 can control humidity by positioning a third component 308 associated with the lid 306 at least partially inside the inlet 303 by coupling the first component 304 and the third component 308. The first component 304 can include a coupling mechanism, such as a hook mechanism 305, that can be fastened around or otherwise attached to the third component 308 of the lid 306. By positioning the third component 308 at least partially inside the inlet 303, unusable space of the first compartment (e.g. space between the division plate 302 and the lid 306) can be decreased. In return, usable space in the first compartment for preserving perishables can be increased while maintaining the humidity of the first compartment for the perishables.

At block 708, the lid assembly 300 can control humidity by positioning the second component 310 at least partially inside a fourth component 314 associated with the lid 306. The second component 310 can be used to adjust a position of the lid 306. In some examples, the division plate 302 can be stationary during a change in position of the lid 306. The second component 310 can be connected to a motor 312 for rotating the second component 310. The rotation of the second component 310 can change a position of the second component 310 with respect to the fourth component 314 to, for example, lift or lower the lid 306. Additionally, the first component 304 and the third component 308 may rotate with respect to one another during movement of the lid 306. In some examples, the lid 306 may open or close automatically in response to detecting a user intent to access the first compartment.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A lid assembly for controlling humidity in a refrigeration appliance, the lid assembly comprising:

a division plate positioned between a first compartment of the refrigeration appliance and a second compartment of the refrigeration appliance for insulating the first compartment, the division plate including a first component defining an inlet in the division plate and a second component protruding from the division plate; and a lid comprising a third component and a fourth component, the third component couplable to the first compartment such that third component is at least partially inside the inlet defined by the first component, and the fourth component couplable to the second component.

2. The lid assembly of claim 1, further comprising a motor associated with the second component, wherein the motor rotates the second component to adjust a position of the lid, and wherein the third component is coupled to the first component during an adjustment to the position of the lid.

3. The lid assembly of claim 1, wherein the lid further comprises an opening for electronics and a sensor, wherein the sensor detects a user intent to access the first compartment, and, in response, the lid assembly automatically adjusts a position of the lid from a closed position to an open position while the third component is coupled to the first component.

4. The lid assembly of claim 1, wherein the first component includes a hook mechanism, the second component is a cylindrical component associated with a motor embedded in the division plate, the third component is a curved member, and the fourth component includes a beveled edge.

5. The lid assembly of claim 4, wherein the lid is positioned to cover a top portion of the first compartment and the division plate is positioned above the lid, and wherein the curved member includes a protruding portion for coupling to the hook mechanism to position to curved member in the inlet.

6. The lid assembly of claim 1, wherein the first component is molded from expanded polystyrene of the division plate.

7. The lid assembly of claim 1, wherein the first component is molded from sheet metal of the division plate, and wherein the first component includes a first hook mechanism fastened around a first portion of the third component and a second hook mechanism fastened around a second portion of the third component.

8. A method comprising:

separating, via a division plate, a first compartment of a refrigeration appliance and a second compartment of the refrigeration appliance, and insulating, via the division plate, the first compartment;

positioning the division plate above a lid, the division plate including a first component defining an inlet in the division plate and a second component protruding from the division plate;

positioning a third component associated with the lid at least partially inside the inlet by coupling the first component and the third component; and positioning the second component at least partially inside a fourth component associated with the lid, the second component usable to adjust a position of the lid.

9. The method of claim 8, further comprising a motor associated with the second component to adjust the position of the lid by:

rotating the second component to adjust the position of the lid, wherein the third component is coupled to the first component during the adjustment of the position of the lid.

10. The method of claim 8, wherein the lid further comprises an opening for electronics and a sensor for enabling the second component to adjust the position of the lid by:

detecting, by a sensor, a user intent to access the first compartment; and subsequent to detecting the user intent, adjusting a position of the lid from a closed position to an open position while the third component is coupled to the first component.

11. The method of claim 8, wherein the first component includes a hook mechanism, the second component is a cylindrical component associated with a motor embedded in the division plate, the third component is a curved member, and the fourth component includes a beveled edge.

12. The method of claim 11, further comprising:

positioning the lid at least partially in the division plate by coupling the curved member, via a protruding portion, to the hook mechanism to position the curved member in the inlet.

13. The method of claim 8, wherein the first component is molded from expanded polystyrene of the division plate.

14. The method of claim 8, wherein the first component is molded from sheet metal of the division plate and positioning a third component associated with the lid at least partially inside the inlet by coupling the first component and the third component further comprises:

fastening a first hook mechanism of the first component around a first portion of the third component; and fastening a second hook mechanism of the first component around a second portion of the third component.

15. A refrigeration appliance comprising:

a first compartment and a second compartment;

a division plate positioned between the first compartment and the second compartment for insulating the first compartment, the division plate including a first component defining an inlet in the division plate and a second component protruding from the division plate; and a lid comprising a third component and a fourth component, the third component couplable to the first compartment such that third component is at least partially inside the inlet defined by the first component, and the fourth component couplable to the second component.

16. The refrigeration appliance of claim 15, further comprising a motor associated with the second component, wherein the motor rotates the second component to adjust a position of the lid, and wherein the third component is coupled to the first component during an adjustment to the position of the lid.

17. The refrigeration appliance of claim 15, wherein the lid further comprises an opening for electronics and a sensor, wherein the sensor detects a user intent to access the first compartment, and, in response, a position of the lid is automatically adjusted from a closed position to an open position while the third component is coupled to the first component.

18. The refrigeration appliance of claim 15, wherein the first component includes a hook mechanism, the second component is a cylindrical component associated with a motor embedded in the division plate, the third component is a curved member, and the fourth component includes a beveled edge.

19. The refrigeration appliance of claim 18, wherein the lid is positioned to cover a top portion of the first compartment and the division plate is positioned above the lid, and wherein the curved member includes a protruding portion for coupling to the hook mechanism to position to curved member in the inlet.

20. The refrigeration appliance of claim 15, wherein the first component is molded from sheet metal of the division plate, and wherein the first component includes a first hook mechanism fastened around a first portion of the third component and a second hook mechanism fastened around a second portion of the third component.

* * * * *